US011306925B2

(12) United States Patent
Kitabatake et al.

(10) Patent No.: US 11,306,925 B2
(45) Date of Patent: Apr. 19, 2022

(54) OUTDOOR UNIT OF AIR-CONDITIONING APPARATUS HAVING TERMINAL-BLOCK MOUNTING PORTION WITH TERMINAL-BLOCK SEAT

(71) Applicant: Mitsubishi Electric Corporation, Tokyo (JP)

(72) Inventors: Yo Kitabatake, Tokyo (JP); Shigeru Hata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/975,442

(22) PCT Filed: Apr. 10, 2018

(86) PCT No.: PCT/JP2018/015087
§ 371 (c)(1),
(2) Date: Aug. 25, 2020

(87) PCT Pub. No.: WO2019/198151
PCT Pub. Date: Oct. 17, 2019

(65) Prior Publication Data
US 2021/0018192 A1 Jan. 21, 2021

(51) Int. Cl.
*F24F 1/22* (2011.01)

(52) U.S. Cl.
CPC ..... *F24F 1/22* (2013.01)

(58) Field of Classification Search
CPC ..... F24F 1/22; F24F 1/20
(Continued)

(56) References Cited

U.S. PATENT DOCUMENTS 7,265,291 B1 * 9/2007 Gorman ..... H02G 3/086 174/66

FOREIGN PATENT DOCUMENTS

EP 3 346 199 A1 7/2018
JP S50-064984 U 6/1975
(Continued)

OTHER PUBLICATIONS

Office Action dated Apr. 30, 2021, issued in corresponding CN Patent Application No. 201880092155.9 (and English Machine Translation).
(Continued)

*Primary Examiner* — Steve S Tanenbaum
(74) *Attorney, Agent, or Firm* — Posz Law Group, PLC

(57) ABSTRACT

An outdoor unit of an air-conditioning apparatus has a structure that enables a terminal block to be added on a front side that a worker can easily contact, without greatly changing the location of an existing terminal block and the basic shape of a mounting portion. In a casing of the outdoor unit, a heat exchanger, an outdoor fan, a compressor, and an electrical component are provided. The outdoor unit includes: terminal blocks to be connected to the electrical component; and a terminal-block mounting portion facing from the inside of the casing toward the outside thereof. The terminal blocks are arranged in the height direction of the terminal-block mounting portion, and include first and second terminal blocks on a lower side and an upper side, respectively. The second terminal block is mounted on a terminal-block seat on the terminal-block mounting portion. The above seat includes a mounting portion on which the second terminal block is mounted, and a fixed portion contacting the terminal-block mounting portion. The fixed portion is smaller than the mounting portion, and the mount-
(Continued)

ing portion protrudes from the fixed portion toward the first terminal block.

8 Claims, 3 Drawing Sheets

(58) Field of Classification Search
USPC ..... 62/259.1
See application file for complete search history.

(56) References Cited

FOREIGN PATENT DOCUMENTS

| | | | | |
|---|---|---|---|---|
| JP | S51-034669 | U | | 3/1976 |
| JP | 2001-133481 | A | | 5/2001 |
| JP | 2006-084106 | A | | 3/2006 |
| JP | 2011-233361 | A | | 11/2011 |
| JP | 2014-047991 | A | | 3/2014 |
| JP | 2017-110881 | A | | 6/2017 |
| JP | 2017110881 | A | * | 6/2017 |
| KR | 2004-0091198 | A | | 10/2004 |
| WO | 2017/037820 | A1 | | 3/2017 |

OTHER PUBLICATIONS

Extended European Search Report dated Mar. 3, 2021, issued in corresponding European Patent Application No. 18914172.4.
International Search Report of the International Searching Authority dated Jul. 10, 2018 for the corresponding international application No. PCT/JP2018/015087 (and English translation).
Office Action dated Aug. 31, 2021, issued in corresponding JP Patent Application No. 2020-512974 (and English Machine Translation).
Office Action dated Oct. 18, 2021 issued in corresponding CN patent application No. 201880092155.9 (and Machine Translation).

* cited by examiner

OUTDOOR UNIT OF AIR-CONDITIONING APPARATUS HAVING TERMINAL-BLOCK MOUNTING PORTION WITH TERMINAL-BLOCK SEAT

CROSS REFERENCE TO RELATED APPLICATION

This application is a U.S. national stage application of PCT/JP2018/015087 filed on Apr. 10, 2018, the contents of which are incorporated herein by reference.

TECHNICAL FIELD

The present disclosure relates to an outdoor unit of an air-conditioning apparatus, and particularly relates to a structure for setting a terminal block for use in communication with an indoor unit, and supplying of power thereto and for other intended use.

BACKGROUND ART

An outdoor unit of an air-conditioning apparatus includes a terminal block to which conductive lines are externally connected, for electric communication with an indoor unit connected to the outdoor unit, supplying power for operation to the outdoor unit, and other purposes. In general, a terminal block is connected in a one-to-one correspondence to an indoor unit. Thus, a multi-type outdoor unit to which a plurality of indoor units are connected needs a plurality of terminal blocks. When an outdoor unit is installed, or an indoor unit is additionally installed, a worker carries out wiring on site. It is therefore preferable that terminal blocks be located on the front side of the outdoor unit in order for the worker to easily contact the terminal blocks from the outside of the outdoor unit. In an existing structure for setting terminal blocks, in which a terminal-block mounting portion having recesses and projections for setting terminal blocks thereon is provided in advance, and the terminal blocks, which are formed to have recesses and projections to be engaged with the projections and recesses of the terminal-block mounting portion, can be arranged side by side in such a manner as to be inserted into the terminal-block mounting portion (see, for example, Patent Literature 1).

CITATION LIST

Patent Literature

Patent Literature 1: Japanese Unexamined Patent Application Publication No. 2006-84106

SUMMARY OF INVENTION

Technical Problem

In the existing structure for setting terminal blocks, a terminal block other than terminal blocks set in advance cannot be added. Thus, when the number of terminal blocks that need to be set is larger than the number of terminal blocks that can be set, the space is not sufficient for the terminal blocks that needs to be set. In such a case, it is necessary to increase the space for setting the terminal blocks, and also to greatly modify the terminal-block mounting portion. In addition, in the case where the terminal blocks are provided on a side of the outdoor unit without greatly modifying the terminal-block mounting portion, wiring cannot be easily carried out.

The present disclosure is applied to solve the above problems, and relates to an outdoor unit of an air-conditioning apparatus having a structure that enables a terminal block to be added on a front side of the outdoor unit where a worker can easily contact when carrying out wiring on site, without greatly changing the location of an existing terminal block or the shape of a terminal-block mounting portion.

Solution to Problem

An outdoor unit of an air-conditioning apparatus according to an embodiment of the present disclosure, which is provided with a heat exchanger, an outdoor fan, a compressor, and an electrical component that are provided in a casing of the outdoor unit, includes: terminal blocks to be connected to the electrical component; and a terminal-block mounting portion provided to face from an inside of the casing toward an outside of the casing. The terminal blocks are arranged in a height direction of the terminal-block mounting portion, and include a first terminal block located on a lower side of the terminal-block mounting portion, and a second terminal block located on an upper side of the terminal-block mounting portion. The second terminal block is mounted on a terminal-block seat provided on the terminal-block mounting portion. The terminal-block seat includes a mounting portion on which the second terminal block is mounted, and a fixed portion that is in contact with the terminal-block mounting portion. The fixed portion is smaller in area than the mounting portion. The mounting portion is formed in such a manner as to protrude from the fixed portion toward the first terminal block.

Advantageous Effects of Invention

In the outdoor unit of an air-conditioning apparatus according to an embodiment of the present disclosure, with the above configuration, the terminal blocks can be located next to each other in the up-down direction of the casing while a wiring space is secured, and the terminal block can be added at a position that is easily accessible to a worker performing wiring work without enlarging the terminal-block mounting portion.

DESCRIPTION OF EMBODIMENT

Embodiment 1

Figure 1:
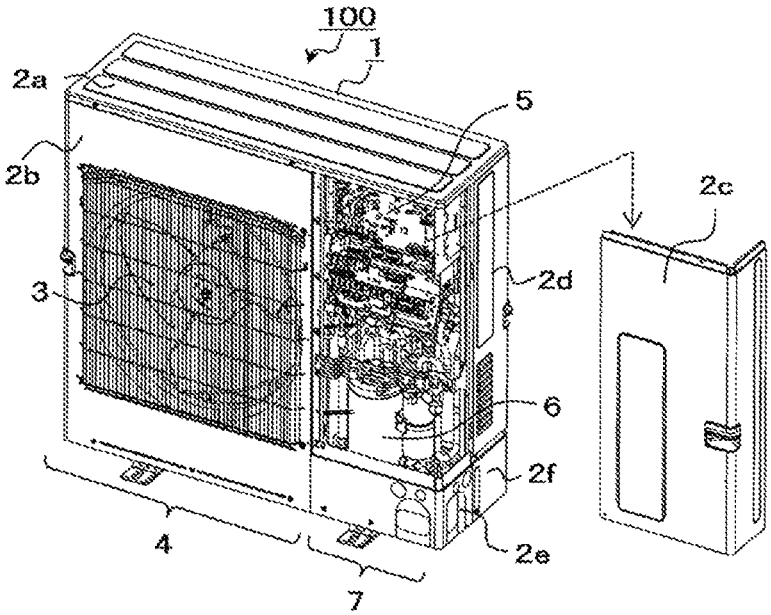
FIG. 1 is a perspective view of an outdoor unit of an air-conditioning apparatus according to Embodiment 1.

An outdoor unit 100 of an air-conditioning apparatus according to an embodiment will be described. The configuration as illustrated in the drawings is merely an example, and the drawings are not limiting. In each of the figures therein, components that are the same as or equivalent to those in a previous figure are denoted by the same reference signs. The same is true of the entire text of the specification. Furthermore, the relationships in size between the components as illustrated in each of the figures may be different from actual ones.

FIG. 1 is a perspective view of the outdoor unit 100 of an air-conditioning apparatus according to Embodiment 1. A casing 1 of the outdoor unit 100 of the air-conditioning apparatus includes a top panel 2*a*, an air-passage front panel 2*b*, a machine-chamber front upper panel 2*c*, a rear upper panel 2*d*, a machine-chamber front lower panel 2*e*, and a rear lower panel 2*f*. The inside of the casing 1 is partitioned by a partition plate into a main air passage 4 in which a blower fan 3 and a heat exchanger (not illustrated) are provided, and a machine chamber 7 in which a compressor 6 and an electrical component 5 are provided. Referring to FIG. 1, the machine-chamber front upper panel 2*c* is removed from the machine chamber 7. It should be noted that a worker who carries out wiring on site installs the outdoor unit 100 of the air-conditioning apparatus, with the machine-chamber front upper panel 2*c* removed from the machine chamber 7.

Figure 2:
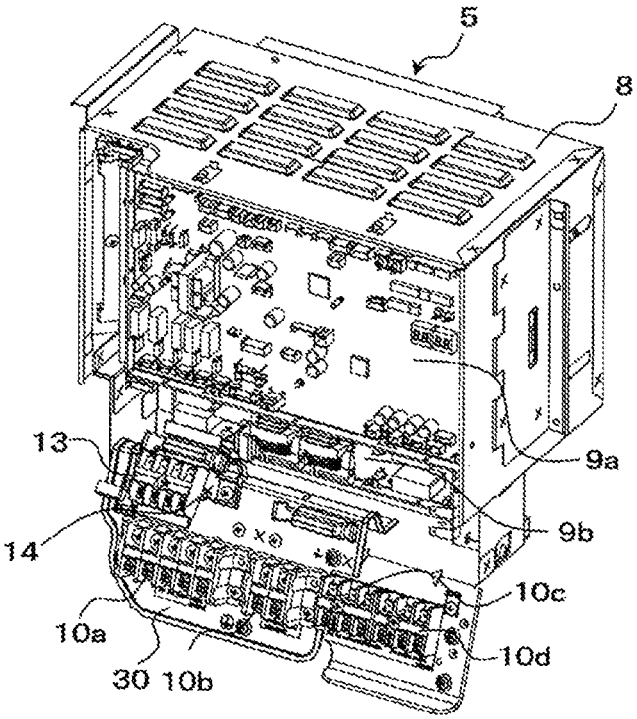
FIG. 2 is an enlarged view of an electrical component as illustrated in FIG. 1.
Figure 3:
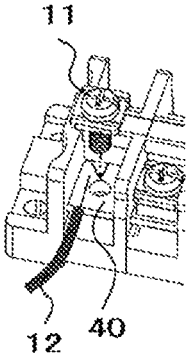
FIG. 3 is an explanatory view of a detailed structure of a terminal block as illustrated in FIG. 2.

FIG. 2 is an enlarged view of the electrical component 5 as illustrated in FIG. 1. FIG. 3 is an explanatory view of a detailed structure of a terminal block 10*a* as illustrated in FIG. 2. An outer shell of the electrical component 5 is covered by an outer-shell metal sheet 8. In the outer shell, boards 9*a* and 9*b* and conductive lines are provided. On a front side of the casing 1, existing terminal blocks 10*a* to 10*d* are provided. The existing terminal blocks 10*a* to 10*d* are fixed to a terminal-block mounting portion 30 that extends downwards from an end portion of the outer-shell metal sheet 8 that is located on the front side of the casing 1. The existing terminal blocks 10*a* to 10*d* are located side by side in a lateral direction of the casing 1. As illustrated in FIG. 3, the existing terminal blocks 10*a* to 10*d* include line-fixing screws 11 each of which fixes a line 12 to a terminal fitting 40.

The terminal block 10*a* and an additional terminal block 13 are located side by side in a height direction of the casing 1. Above the terminal block 10*a*, the additional terminal block 13 is mounted. The additional terminal block 13 is fixed to a surface of a mounting portion 50 of a terminal-block seat 14 fixed to the terminal-block mounting portion 30. That is, the additional terminal block 13 is not provided parallel to the existing terminal blocks 10*a* to 10*d*, that is, the additional terminal block 13 is offset from the existing terminal blocks 10*a* to 10*d* in the height direction.

Figure 4:
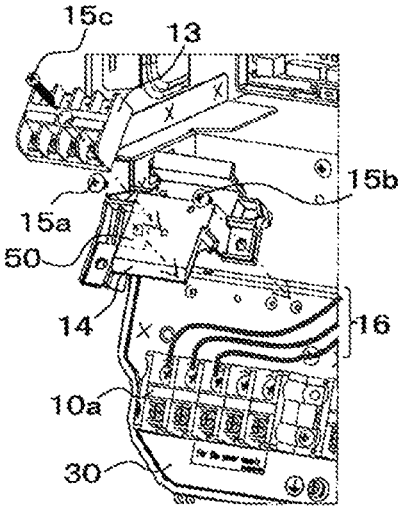
FIG. 4 is an exploded view of an additional terminal block as illustrated in FIG. 2.

FIG. 4 is an exploded view of the additional terminal block 13 as illustrated in FIG. 2. The terminal-block seat 14 is fixed to the terminal-block mounting portion 30 by fixing screws 15*a* and 15*b*. The fixing screws 15*a* and 15*b* are passed through holes provided in the terminal-block seat 14, and then screwed into screw holes provided in the terminal-block mounting portion 30 and fixed to the terminal-block mounting portion 30. The additional terminal block 13 is fixed to the mounting portion 50 of the terminal-block seat 14 by a screw 15*c*.

Figure 5:
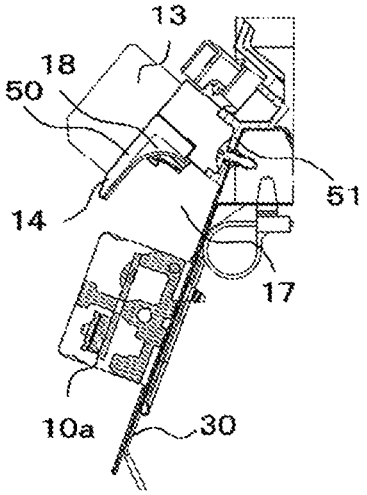
FIG. 5 is an explanatory view of a sectional structure including an existing terminal block and the additional terminal block as illustrated in FIG. 2.

FIG. 5 is an explanatory view of a sectional structure including the existing terminal block 10*a* and the additional terminal block 13 as illustrated in FIG. 2. The terminal-block seat 14 is fixed above and parallel to the existing terminal block 10*a*. The additional terminal block 13 is fixed to the terminal-block mounting portion 30, with the terminal-block seat 14 interposed between the additional terminal block 13 and the terminal-block mounting portion 30.

A fixed portion 51 of the terminal-block seat 14 that is fixed to the terminal-block mounting portion 30 is formed smaller than the mounting portion 50 to which the terminal block 13 is fixed. The mounting portion 50 protrudes further toward the existing terminal block 10*a* than the fixed portion 51. That is, in the sectional structure, space 17 is provided in such a manner as to be surrounded by the mounting portion 50, one of sides of the additional terminal block 13 that is closer to the existing terminal block 10*a*, the terminal-block mounting portion 30, and one of sides of the existing terminal block 10*a* that faces the terminal-block seat 14. Because of provision of such a configuration, even if the additional terminal block 13 is provided close to the existing terminal block 10*a* as viewed in a direction perpendicular to the terminal-block mounting portion 30, it is ensured that the space 17 allows lines 16 to pass through the space 17. Thus, even in a narrow region, the additional terminal block 13 can be set. Although the existing terminal block 10*a* and the additional terminal block 13 are located close to each other as viewed from the direction perpendicular to the terminal-block mounting portion 30, the wiring can be easily carried out, since the additional terminal block 13 is offset from the terminal-block mounting portion 30 in the height direction.

As illustrated in FIG. 5, regarding the terminal-block seat 14 to which the additional terminal block 13 is fixed, a side surface of the terminal-block seat 14 that faces the existing terminal block 10*a* is curved upwardly. The space 17 is covered by the mounting portion 50 of the terminal-block seat 14. A corner portion 18 provided between the mounting portion 50 and the side surface of the terminal-block seat 14, which also faces the space 17, has a curved surface. That is, floating of the lines 16, which extend from the existing terminal-block seat 14, is prevented by the mounting portion 50.

The distance from one of end portions of the bottom of the additional terminal block 13 that is closer to the existing terminal block 10*a* to the terminal-block mounting portion 30 is greater than the height of the existing terminal block 10*a* from the terminal-block mounting portion 30. Because of such a configuration, the lines 16 connected to the existing terminal block 10*a* can be set without changing a connection method even in the case where the additional terminal block 13 has already been set.

Figure 6:
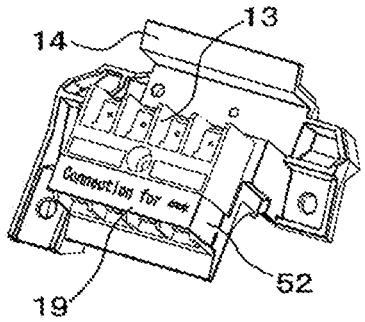
FIG. 6 is an enlarged view of the additional terminal block and a terminal-block seat as illustrated in FIG. 2.
Figure 7:
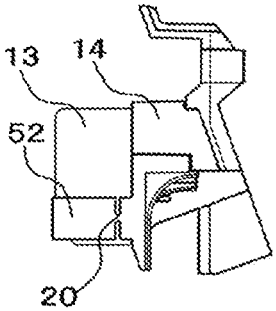
FIG. 7 is a side view of the additional terminal block and the terminal-block seat as illustrated in FIG. 5.
Figure 8:
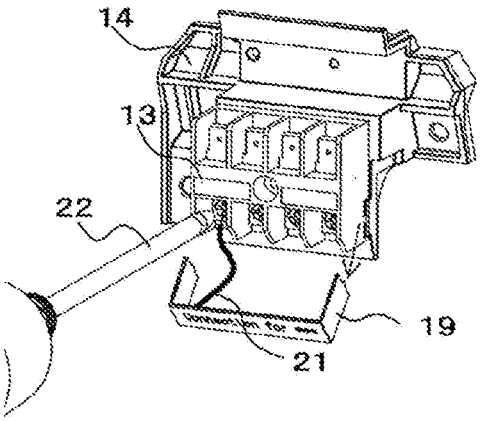
FIG. 8 is an explanatory view illustrating a state in which a guard portion is removed from the additional terminal block in FIG. 5.

FIG. 6 is an enlarged view of the additional terminal block 13 and the terminal-block seat 14 as illustrated in FIG. 2. FIG. 7 is a side view of the additional terminal block 13 and the terminal-block seat 14 as illustrated in FIG. 5. FIG. 8 is an explanatory view illustrating a state in which a guard portion 19 is removed from the additional terminal block 13 in FIG. 5. As illustrated in FIG. 6, the terminal-block seat 14 can be provided with the guard portion 19. The additional terminal block 13 is inserted and fixed between the mounting portion 50 and the guard portion 19 provided at the terminal-block seat 14. The guard portion 19 is provided in such a manner as to cover line-fixing screws at the additional terminal block 13, and information, for example, a connection destination, can be written on a surface of the guard portion 19.

The guard portion 19 has two leg portions 52 that extend toward the mounting portion 50 at a side portion of the terminal-block seat 14. Each of the two leg portions 52 is provided with a knockout portion 20, thus allowing the worker who carries out wiring to easily remove the guard portion 19 from the terminal block 13. A line 21 is connected to the additional terminal block 13 fusing illustrated tool 22) by removing a line-fixing screw and then fixing the line 21 in such a manner as to be held between the line-fixing screw and the additional terminal block 13. Therefore, a step of removing the line-fixing screw is indispensable in the work. Before the guard portion 19 is removed from the terminal block 13, line-fixing screws thereof are covered by the guard portion 19, and thus cannot be removed. Thus, for example, in the case where a plurality of terminal blocks are provided, a terminal block to which a line is to be connected is visually recognized, and then the guard portion 19 thereof can be removed from the terminal block, thereby preventing the line from being erroneously connected. Also, since on the guard portion 19, the connection destination is displayed, lines can be reliably connected.

It is described above that only one additional terminal block 13 is provided in the outdoor unit 100 of the air-conditioning apparatus. However, a further additional terminal block 13 with a further terminal-block seat 14 may be provided adjacent to the above additional terminal block 13 in the lateral direction. Because of such a configuration, it is also possible to connect a larger number of indoor units to the outdoor unit 100 of the air-conditioning apparatus than in the above case. Even in the case where the number of the additional terminal blocks 13 and the number of the terminal block seats 14 are increased, since the space 17 for provision of the lines 16 to be connected to the existing terminal blocks 10*a* to 10*d* is ensured as described above, the lines 16 can be set without reducing the workability.

REFERENCE SIGNS LIST

1 casing 2*a* top panel 2*b* air-passage front panel 2*c* machine-chamber front upper panel 2*d* rear upper panel 2*e* machine-chamber front lower panel 2*f* rear lower panel 3 blower fan 4 main air passage 5 electrical component 6 compressor 7 machine chamber 8 outer-shell metal sheet 9*a* board 9*b* board 10*a* terminal block 10*b* terminal block 10*c* terminal block 10*d* terminal block 11 line-fixing screw 12 wire 13 terminal block 14 terminal-block seat 15*a* fixing screw 15*b* fixing screw 15*c* screw 16 line 17 space 18 corner portion 19 guard portion 20 knockout portion 21 line 30 terminal-block mounting portion 40 terminal fitting 50 mounting portion 51 fixed portion 52 leg portion 100 outdoor unit

The invention claimed is:

1. An outdoor unit of an air-conditioning apparatus, which is provided with a heat exchanger, an outdoor fan, a compressor, and an electrical component that are provided in a casing of the outdoor unit, the outdoor unit comprising:

terminal blocks to be connected to the electrical component; and a terminal-block mounting portion provided to face from an inside of the casing toward an outside of the casing, wherein the terminal blocks are arranged in a height direction of the terminal-block mounting portion, and include a first terminal block located on a lower side of the terminal-block mounting portion, and a second terminal block located on an upper side of the terminal-block mounting portion, wherein the second terminal block is mounted on a terminal-block seat provided on the terminal-block mounting portion, wherein the terminal-block seat includes a mounting portion on which the second terminal block is mounted, and a fixed portion that is in contact with the terminal-block mounting portion, wherein the fixed portion is smaller in area than the mounting portion, wherein the mounting portion is formed in such a manner as to protrude from the fixed portion toward the first terminal block, and wherein the mounting portion protrudes further toward the first terminal block than the fixed portion protrudes toward the first terminal block.

2. The outdoor unit of the air-conditioning apparatus of claim 1, the second terminal block having a bottom facing the terminal-block mounting portion, the bottom having end portions including one end portion that is closest to the first terminal block, the first terminal block having a top on a side opposite the terminal-block mounting portion, wherein a distance from the terminal-block mounting portion to the one end portion is greater than a height of the top of the first terminal block from the terminal-block mounting portion.

3. The outdoor unit of the air-conditioning apparatus of claim 1, wherein the fixed portion is located above the first terminal block in a height direction of the casing.

4. The outdoor unit of the air-conditioning apparatus of claim 1, wherein a line connected to the first terminal block extends between the terminal-block seat and the first terminal block.

5. The outdoor unit of the air-conditioning apparatus of claim 4, wherein the line connected to the first terminal block extends through a region that is surrounded by a side of the terminal-block seat that faces the first terminal block, part of the mounting portion that protrudes from the fixed portion, the terminal-block mounting portion, and a side of the first terminal block that faces the terminal-block seat.

6. The outdoor unit of the air-conditioning apparatus of claim 1, wherein the terminal-block seat includes a guard portion configured to cover a line-fixing screw of the second terminal block.

7. The outdoor unit of the air-conditioning apparatus of claim 6, wherein the guard portion includes a knockout portion at a side portion of the terminal-block seat.

8. The outdoor unit of the air-conditioning apparatus of claim 6, wherein on the guard portion, a connection destination of a line to be connected to the line-fixing screw is indicated.

* * * * *